US008485384B2

(12) United States Patent
Gottschling et al.

(10) Patent No.: US 8,485,384 B2
(45) Date of Patent: Jul. 16, 2013

(54) REFRIGERATOR

(75) Inventors: Rudolf Gottschling, Bad Wurzach (DE); Erich Harsch, Karrenweg (DE)

(73) Assignee: Liebherr-Hausgeräte Ochsenhausen GmbH, Ochsenhausen (DE)

( * ) Notice: Subject to any disclaimer, the term of this patent is extended or adjusted under 35 U.S.C. 154(b) by 1421 days.

(21) Appl. No.: 12/084,020

(22) PCT Filed: Oct. 24, 2006

(86) PCT No.: PCT/EP2006/010247

§ 371 (c)(1),
(2), (4) Date: Apr. 23, 2008

(87) PCT Pub. No.: WO2007/048578

PCT Pub. Date: May 3, 2007

(65) Prior Publication Data

US 2009/0158769 A1 Jun. 25, 2009

(30) Foreign Application Priority Data

Oct. 24, 2005 (DE) ..... 20 2005 016 631 U
Dec. 15, 2005 (DE) ..... 20 2005 019 586 U

(51) Int. Cl.
*B65D 25/04* (2006.01)
*F25D 23/12* (2006.01)

(52) U.S. Cl.
USPC ..... 220/532; 220/592.02

(58) Field of Classification Search
USPC ..... 220/532, 533, 592.02, 592.1; 312/407, 312/408, 406
See application file for complete search history.

(56) References Cited

U.S. PATENT DOCUMENTS

| | | | | |
|---|---|---|---|---|
| 2,330,044 | A * | 9/1943 | Gaston | 312/293.2 |
| 3,680,177 | A * | 8/1972 | Ginsberg | 220/533 |
| 4,191,434 | A * | 3/1980 | Powell et al. | 312/407 |
| 5,577,822 | A * | 11/1996 | Seon | 312/404 |
| 5,855,424 | A * | 1/1999 | Hamilton et al. | 312/408 |
| 6,471,313 | B1 * | 10/2002 | Ueda et al. | 312/406.2 |
| 6,612,671 | B2 * | 9/2003 | Disbennett et al. | 312/408 |
| 2005/0067930 | A1 * | 3/2005 | Shin | 312/408 |
| 2006/0163985 | A1 * | 7/2006 | Blersch et al. | 312/408 |
| 2006/0232177 | A1 * | 10/2006 | Filho et al. | 312/407 |
| 2008/0180013 | A1 * | 7/2008 | Lee et al. | 312/406 |

FOREIGN PATENT DOCUMENTS

| | | |
|---|---|---|
| DE | 299 02 095 | 6/1999 |
| GB | 895548 | 5/1962 |
| WO | 2004/059227 | 7/2004 |
| WO | 2005/100889 | 10/2005 |

* cited by examiner

*Primary Examiner* — Mickey Yu
*Assistant Examiner* — Niki Eloshway
(74) *Attorney, Agent, or Firm* — Dilworth & Barrese, LLP.

(57) ABSTRACT

A refrigerator with a refrigerated goods container on its back accommodates a vertical partition, which is connected via at least one holder in the vicinity of its upper edge and with the refrigerated goods container. At least one receiving portion is molded in the refrigerated goods container, in which the at least one holder of the partition can be hooked in.

9 Claims, 3 Drawing Sheets

REFRIGERATOR

BACKGROUND OF THE INVENTION

The invention relates to a refrigerator with a refrigerated goods container, which on its back accommodates a vertical partition, according to the description herein.

In refrigerators, it is already known that in the refrigerated goods container a partition separates the region for accommodating the goods to be refrigerated from an aggregate part on the back of the region for accommodating the goods to be refrigerated. These vertical partitions usually are mounted in the vicinity of the ceiling. In refrigerators with a 4-star cooling compartment, the vertical partition is guided in a bushing which is screwed into the ceiling of the 4-star cooling compartment. In accordance with one alternative, the partition is resiliently clamped into a ceiling shaft on the container ceiling of the refrigerated goods container.

In various types of currently realized refrigerators, a fan is mounted in the partition in direct vicinity of these attachments. The corresponding vibrations, which propagate into the mounting regions, result in unsatisfactory noise emissions.

For compensating the linear expansion of the partitions, two sliding elements additionally are premounted per partition and subsequently screwed to the same. To maintain the desired spacing in the refrigerated goods container for long partitions, two elastic spacers are molded to the same, which likewise must be screwed to the container.

SUMMARY OF THE INVENTION

Known refrigerators thus involve a comparatively high amount of built-in components and a high mounting effort for mounting the partition in the refrigerated goods container.

Therefore, it is the object of the invention to simplify the assembly of the vertical partition in the refrigerated goods container such that beside a fast assembly no or only few additional parts possibly must be inserted.

In accordance with the invention, this object is solved by the combination of features herein. In a refrigerator with a refrigerated goods container which on its back accommodates a vertical partition, which is connected with the refrigerated goods container via at least one holder in the vicinity of the upper edge, at least one receiving portion is molded in the refrigerated goods container in accordance with the invention, in which the at least one holder of the partition can be hooked in. In this solution, the receiving portion for the partition is directly molded to the refrigerated goods container. This is effected in one step with the drawing of the container, so that beside the simplified assembly an advantage in terms of manufacturing technology also is achieved during manufacture of the refrigerator. The holder on the partition also can directly be injection-molded when manufacturing the partition made of plastics.

Preferred aspects of the invention can also be taken from the description herein.

When the partition exceeds a certain height, spacers additionally are provided in the lateral middle region of the partition in addition to the inventive holder provided in the vicinity of the upper edge. In accordance with the invention, said spacers can be snapped into corresponding recesses in the refrigerated goods container with one clip-type connector each.

Furthermore, the receiving portion in the refrigerated goods container can include an undercut, with the receiving portion being configured such that the partition with its at least one holder, whose outer contour is conformed to the undercut, can be swiveled into this receiving portion.

In the front part of the holder molded to the partition, a nose is molded in addition. In the front part of the holder, the nose height can be used for adjusting whether the connection between holder and receiving portion is free from clearance, provided with a small clearance or with a large clearance.

In accordance with a further preferred aspect of the invention, the clip-type connector of the spacer consists of two parallel resilient tongues. These tongues engage in corresponding recesses in the refrigerated goods container for receiving the spacers when mounting the partition.

Furthermore, the recesses in the refrigerated goods container advantageously are arranged in the rear part of the refrigerated goods container for receiving the spacers of the partition in the vicinity of the indentations forming the receiving grooves for the trays. It can thereby be prevented that the corresponding recesses laterally protrude beyond the outer lateral boundary of the refrigerated goods container.

BRIEF DESCRIPTION OF THE DRAWINGS

Further features, details and advantages of the invention will be explained in detail with reference to an embodiment illustrated in the drawing, in which:

FIG. 3: shows a perspective view with a longitudinal section through the container, with the spacer of the partition being clipped in.

DESCRIPTION OF THE PREFERRED EMBODIMENTS

Figure 1:
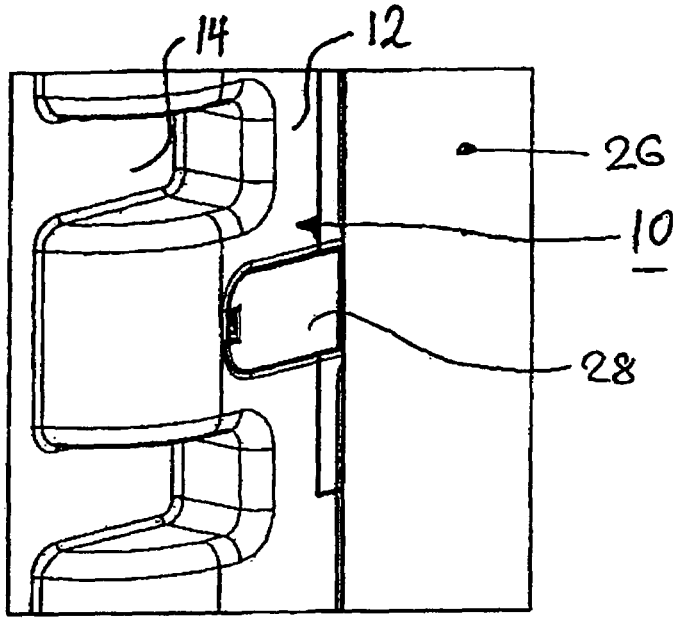
FIG. 1: shows a section of the rear corner portion of a refrigerated goods container in viewing direction of the refrigerated goods container.

FIG. 1 shows a rear corner portion of a refrigerated goods container, in which indentations 12 are formed for forming receiving grooves 14 for inserting trays not shown in detail here. The entire refrigerated goods container 10 is drawn as a plastics container, wherein all shapes, such as the indentations 12, are also formed during this drawing operation.

Figure 2:
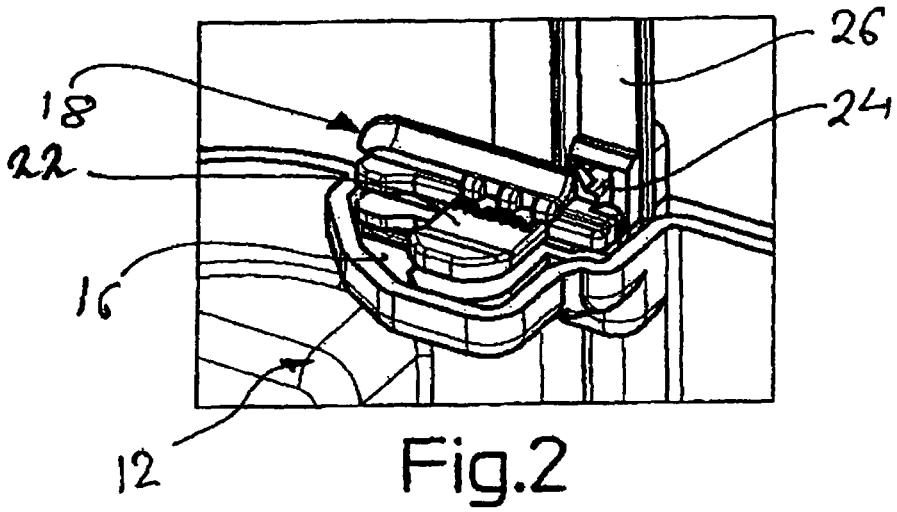
FIG. 2: shows a perspective view of a cross-section through the refrigerated goods container with a spacer of the partition laterally clipped in, with the viewing direction being directed onto the refrigerated goods container from outside.
Figure 3:
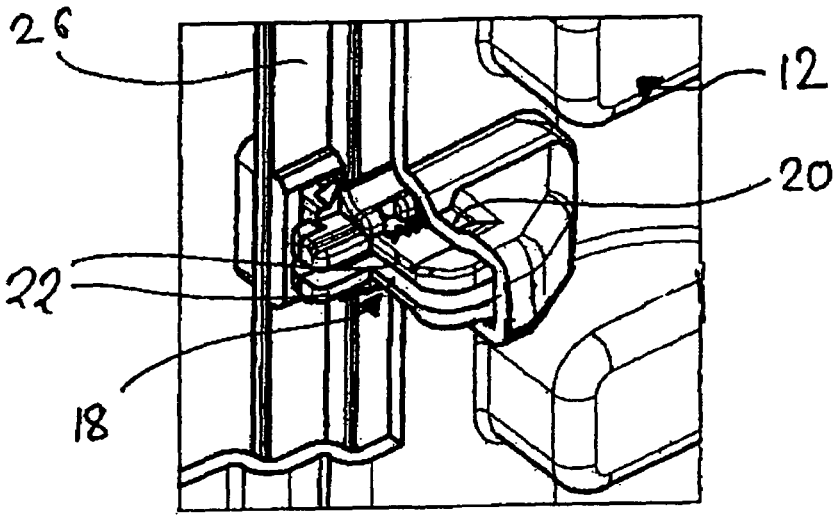
Figure 4:
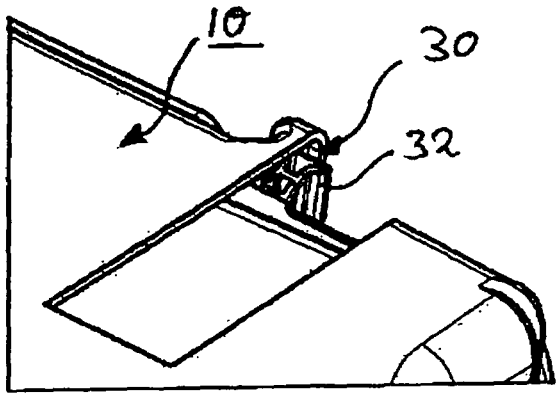
FIG. 4: shows a perspective representation of the ceiling holding geometry, with a corner portion of the refrigerated goods container being cut away.
Figure 5:
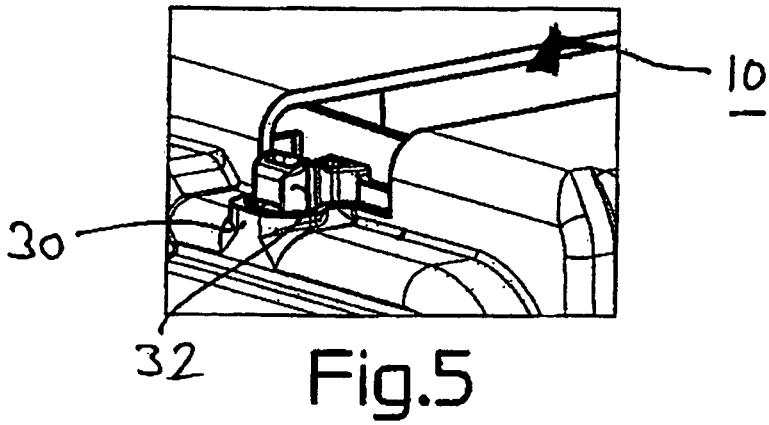
FIG. 5: shows a representation of the geometry of the holder in the ceiling region of the refrigerated goods container corresponding to FIG. 4 with a viewing direction from the back.
Figure 6:
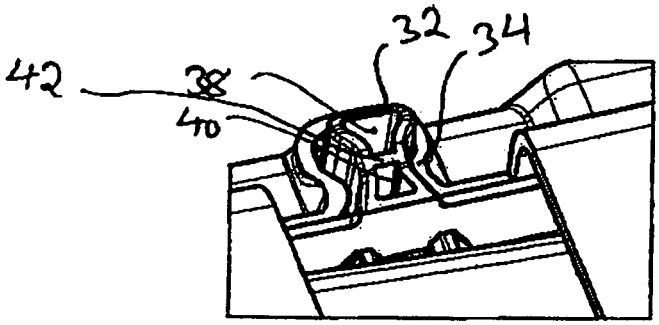
FIG. 6: shows the geometry of the holding means in accordance with the present invention as shown in FIGS. 4 and 5, but here in a viewing direction obliquely from the top.

In FIGS. 2 and 3 it is shown that recesses 16 are formed in the vicinity of the indentations 12, into which corresponding spacers 18 can be snapped or clipped. In FIGS. 2 and 3, the indentations 12 each are shown from the back, whereas in FIG. 1 they are shown as seen from the inside of the refrigerated goods container.

The recesses 16 in the refrigerated goods container include two molded depressions 20 located opposite each other, which can be seen in FIG. 3. Accordingly, the spacers 18 include two parallel resilient tongues 22, which in their terminal region extend upwards at an angle. When clipping in, the two tongues 22 are compressed due to the terminal regions bent up, until they have been moved through below the depressed regions 20 in the enclosing recess 16 and rest against the bevel of these regions 20 upon overcoming this resistance and thus form a positive connection. The spacers 18 in turn are connected with the vertical partition 26 via an oblong guideway 24. To achieve a smooth outer contour in the refrigerated goods container 10, the respective spacer is shaped such that its outer surface 28 terminates flush with the outer contour of the indentation 12, so that a flat surface is obtained.

The suspension of the partition in the upper region of the refrigerated goods container will now be explained with reference to FIGS. 4-7. In the refrigerated goods container 10, a receiving portion 30 is molded, in which a holder 32, which is injection molded in the upper part of the partition, can be hung in. As can in particular also be taken from FIG. 6, the receiving portion 30 each includes lateral undercuts 34, to which the holder 32 is conformed.

The receiving portion 30 for receiving and mounting the holder 32 of the partition 26, is molded to the refrigerated goods container 10 right during manufacture.

The holder 32 of the partition 26 is configured such that the vertical partition can be inserted with a large clearance in a swivel movement. The clearance advantageous for mounting will only be eliminated during the last part of the movement.

Figure 7:
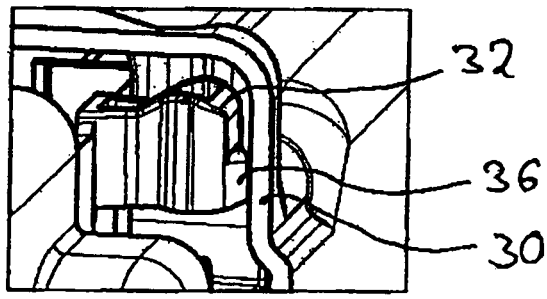
FIG. 7: shows a representation corresponding to FIGS. 4-6, which here shows a lateral perspective view with a longitudinal section through the rear corner portion of the refrigerated goods container in the vicinity of the attachment.

In the front part, the holder 32 includes a molded nose 36, which in the mounted condition, as shown in FIG. 7, rests against the receiving portion 30 of the refrigerated goods container 10. Depending on the height of this nose 36, the clearance of the connection can be adjusted. With a very high nose 36, the connection largely is free from clearance. With decreasing height, the adjusted clearance is increasing. The holder 32 of the partition is rounded in its upper part to provide for a separating movement, as is shown in particular in FIG. 7. It is provided with cavities 38 and 40 for molding and weight reasons, with these cavities 38 and 40 being interrupted by an intermediate web 42, which serves to increase the strength.

With the configuration of the refrigerator in accordance with the invention, the partition can easily be mounted in the refrigerated goods container by swiveling or clipping in without any particular components and means such as screws or connecting members which can be lost.

Both the refrigerated goods container and the partition substantially can be manufactured in one step. The corresponding receiving portions and recesses can be formed advantageously when drawing the refrigerated goods container.

For small undercuts up to 1 mm, removal from the drawing mold is possible by forced demolding, as the plastic material has a sufficiently high elasticity. In this way, the clip connection described above can easily be made. Here, small to medium mechanical loads can be absorbed in mounting direction. This connection is suitable for the spacers of the partition, which are necessary in particular with large partitions. The holding region of the recess here is elastically designed such that when clipping in the path of displacement can be accommodated.

For larger undercuts, above about 1 mm, removal from the drawing mold is possible via a corresponding arrangement of tool bars. The contour thus is opened at least on the side of the bar. Such configuration is particularly useful for so-called "loose bearings" for greater mechanical requirements. The connection is made by inserting the counter-geometry into the undercut. A movement only is possible in the desired direction, for instance along the path of linear expansion. The limitation of the path in direction of movement also can be incorporated. This shaping of the refrigerated goods container is used for forming the receiving portion.

The invention claimed is:

1. A refrigerator with a refrigerated goods container (10) which on a rear side thereof accommodates a vertical partition (26), wherein the partition (26) comprises at least one holder (32) integrally molded thereto in a vicinity of an upper edge thereof, the refrigerated goods container comprises at least one receiving portion (30) integrally molded thereto and in which the at least one holder (32) of the partition (26) is hookable, the vertical partition (26) comprises at least two spacers (18) integrally molded thereto in a lateral middle region thereof, the spacers (18) each, in turn, comprising a pair of tongues (22), the refrigerated goods container (10) comprises corresponding recesses (16) arranged such that the tongues (22) of the partition (26) are snappable into the corresponding recesses (16) in the refrigerated goods container (10), and the recesses (16) each include two molded depressions (20) located opposite each other, such that the vertical partition (26) and goods container (10) are directly and securely couplable together in the absence of separate coupling components.

2. The refrigerator according to claim 1, wherein the receiving portion (30) in the refrigerated goods container (10) includes an undercut (34), with the receiving portion (30) being configured such that the partition (26) with its at least one holder (32) having an outer contour conformed to the undercut (34), is swivelable into the receiving portion (30).

3. The refrigerator according to claim 2, wherein a nose (36) is molded to the front part of the holder (32).

4. The refrigerator according to claim 1, wherein a nose (36) is molded to the front part of the holder (32).

5. The refrigerator according to claim 1, wherein a clip-type connector of the spacer (18) is composed of two parallel resilient tongues (22).

6. The refrigerator according to claim 5, wherein the recesses (16) in the refrigerated goods container (10) are arranged in the rear part of the refrigerated goods container (10) for receiving the spacers (18) of the partition (26) in the vicinity of indentations (12) forming receiving grooves (14) for trays.

7. The refrigerator according to claim 1, wherein the depressions (20) are bevelled and tongues (22) are parallel, resilient and each extending upwardly in a terminal region, such that upon coupling, the tongues (22) are compressed until having been moved through and below the depressions (20) and rest against the bevels of the depressions (20) to form a positive connection.

8. The refrigerator according to claim 1, additionally comprising an oblong guideway (24) interconnecting the spacers (18) and partition (26).

9. A refrigerator with a refrigerated goods container (10) which on a rear side thereof accommodates a vertical partition (26), wherein the partition (26) comprises at least one holder (32) integrally molded thereto in a vicinity of an upper edge thereof, the refrigerated goods container comprises at least one receiving portion (30) integrally molded thereto and in which the at least one holder (32) of the partition (26) is hookable, the vertical partition (26) comprises at least two spacers (18) integrally molded thereto in a lateral middle region thereof, the spacers (18) each, in turn, comprising a pair of tongues (22), the refrigerated goods container (10) comprises corresponding recesses (16) arranged such that the tongues (22) of the partition (26) are snappable into the corresponding recesses (16) in the refrigerated goods container (10), recesses (16) in the refrigerated goods container (10) are arranged in the rear part of the refrigerated goods container (10) for receiving the spacers (18) of the partition (26) in the vicinity of indentations (12) forming receiving grooves (14) for trays, and upon coupling, an outer surface (28) of the spacer (18) terminates flush with an outer contour of the indentation (12) to present a flat surface, such that the vertical partition (26) and goods container (10) are directly and securely couplable together in the absence of separate coupling components.

* * * * *